United States Patent [19]

Miller et al.

[11] Patent Number: 4,753,367

[45] Date of Patent: Jun. 28, 1988

[54] WASTEBASKET AND INNER LINER RETAINER

[75] Inventors: David C. Miller, Ridgefield; Thomas J. Pendleton, Danbury, both of Conn.

[73] Assignee: Mobil Oil Corporation, New York, N.Y.

[21] Appl. No.: 109,875

[22] Filed: Oct. 19, 1987

[51] Int. Cl.[4] ..... B65D 07/12

[52] U.S. Cl. ..... 220/404; 220/1 T; 383/33

[58] Field of Search ..... 220/1 T, 404, 407, 73; 383/33

[56] References Cited

U.S. PATENT DOCUMENTS

| | | | |
|---|---|---|---|
| 165,586 | 4/1875 | James | 248/85 |
| 313,515 | 3/1885 | Parker | 248/99 |
| 1,037,265 | 9/1912 | Kirkpatrick | 248/94 |
| 1,650,447 | 11/1927 | Heyer | 248/99 |
| 2,145,613 | 1/1939 | Shenk et al. | 220/63 |
| 2,421,740 | 6/1947 | Birch, Jr. | 248/101 |
| 2,987,216 | 6/1961 | Fletcher | 220/39 |
| 3,070,829 | 1/1963 | Peras | 16/85 |
| 3,180,384 | 4/1965 | Seifert | 150/1 |
| 3,204,866 | 9/1965 | Brighton et al. | 232/43.2 |
| 3,240,487 | 3/1966 | Backlund et al. | 248/99 |
| 3,443,745 | 5/1969 | Kleeberg | 232/43.2 |
| 3,451,582 | 6/1969 | Morgan | 220/404 X |
| 3,529,766 | 9/1970 | Mott, Sr. et al. | 232/43.2 |
| 3,531,823 | 6/1975 | Cornelius | 16/191 |
| 3,556,395 | 1/1971 | Herman | 232/43.2 |
| 3,563,452 | 2/1971 | Cantella | 232/43.2 |
| 3,567,065 | 3/1971 | Dinse | 220/31 |
| 3,603,542 | 9/1971 | Grille | 248/98 |
| 3,648,875 | 3/1972 | Lundgren | 220/1 T |
| 3,653,620 | 4/1972 | Benoit | 248/101 |
| 3,658,233 | 4/1972 | Voytko | 229/23 |
| 3,779,419 | 12/1973 | Heitz | 220/63 R |
| 3,784,049 | 1/1974 | Hawk | 220/63 |
| 3,827,348 | 8/1974 | Hennells | 100/53 |
| 3,836,037 | 9/1974 | Bass | 220/35 |
| 3,841,466 | 10/1974 | Hoffman et al. | 206/205 |
| 3,860,141 | 1/1974 | Hawk | 220/338 |
| 3,888,386 | 6/1975 | Svensson | 220/335 |
| 3,964,630 | 6/1976 | Getz | 220/404 |
| 4,069,965 | 1/1978 | Maddox, Jr. | 232/19 |
| 4,128,055 | 12/1978 | Hellmann | 100/245 |
| 4,164,178 | 8/1979 | Baumann et al. | 100/99 |
| 4,291,818 | 9/1981 | Nozawa et al. | 220/335 |
| 4,338,979 | 7/1892 | Dow | 141/10 |
| 4,362,118 | 12/1982 | Koch, Jr. et al. | 114/201 R |
| 4,399,928 | 9/1983 | Klingler | 220/335 |
| 4,418,835 | 12/1983 | Watts | 220/404 |
| 4,441,637 | 4/1984 | Libit | 222/556 |
| 4,448,327 | 5/1984 | Gahm | 220/341 |
| 4,477,355 | 4/1984 | Cary | 220/1 T |
| 4,488,697 | 12/1984 | Garvey | 248/101 |
| 4,535,911 | 8/1985 | Goulter | 220/404 |
| 4,550,440 | 10/1985 | Rico | 383/33 |
| 4,598,838 | 7/1986 | Zakrajsek | 220/404 |
| 4,630,752 | 12/1986 | DeMars | 220/1 T |

FOREIGN PATENT DOCUMENTS

| | | |
|---|---|---|
| 478788 | 11/1951 | Canada . |
| 400890 | 10/1965 | Switzerland . |

*Primary Examiner*—Steven M. Pollard
*Attorney, Agent, or Firm*—Alexander J. McKillop; Michael G. Gilman; Charles J. Speciale

[57] ABSTRACT

A wastebasket which is adapted to receive an inner liner includes a container having an upper rim defining an open end, and a lid pivotally mounted on the container and adapted to cover the open end. A bezel is provided for releasably retaining an inner liner in the container. The bezel is pivotally mounted on the container at its open end, and is pivotable between first position, when the bezel is disposed substantially co-planarly with the upper rim of the container, and a second position, where the bezel is raised at an angle above the rim of the container. The wastebasket also includes structure for pivotally mounting the bezel to the container and for retaining the bezel in the raised second position.

11 Claims, 6 Drawing Sheets

WASTEBASKET AND INNER LINER RETAINER

BACKGROUND OF THE INVENTION

1. Field Of The Invention

The present invention relates to wastebaskets or trash receptacles, and more particularly relates to a wastebasket which is adapted to receive and hold an inner liner in place within the wastebasket.

2. Description Of The Prior Art

Wastebaskets or trash receptacles which are adapted to receive and retain an inner liner in place are well known in the art. For example, U.S. Pat. No. 3,779,419, which issued to Charles Heitz, discloses a trash receptacle having a retainer ring which is adapted to hold an inner liner in place within the receptacle. The retainer ring rests on the upper edge of the trash receptacle, and the open end portion of the liner is tucked inside the receptacle between the retainer ring and the receptacle walls.

One of the disadvantages of the trash receptacle disclosed in the Heitz patent is that it is cumbersome to change inner liners. No provision is made to support the retainer ring in a raised position at an angle from the horizontal. The ring is loosely supported on the upper edge of the receptacle. To replace inner liners, one must hold the ring in a raised position with one hand while fitting the liner around the ring with the other hand.

Similarly, U.S. Pat. No. 3,556,395, which issued to Ralph Herman, discloses a bag holder having a bag retainer ring which may be raised and lowered about an opening in the holder.

The ring is mounted to the holder by a spring biased pin mechanism which provides enough play to allow the ring to be raised while in a horizontal position above the upper rim of the bag holder. The mechanism used for mounting the ring also allows the ring to be pivoted to a vertical position.

The bag holder disclosed in the Herman patent suffers from the same design deficiencies discussed previously with respect to the Heitz receptacle. That is, there is no provision in the Herman bag holder to lock the ring in a raised position at an angle from the horizontal so that both hands will be free when fitting the inner liner in place about the liner retaining ring. The ring normally rests in a horizontal position and must be raised by hand against the force of the biasing spring when replacing inner liners. Although the ring can pivot so that it rests in a vertical position, there is no provision to lock the ring in this position or at an angle to the vertical, so that one must still hold the ring with one hand while maneuvering the inner liner with the other.

OBJECTS AND SUMMARY OF THE INVENTION

It is an object of the present invention to provide a wastebasket which is adapted to hold an inner liner securely in the wastebasket and which minimizes the effort to replace inner liners.

It is another object of the present invention to provide a wastebasket having a retaining device for mounting an inner liner in the basket, which retaining device is pivotally mounted on the wastebasket and may be locked in a raised position above the wastebasket to facilitate fitting an inner liner in place.

It is yet a further object of the present invention to provide a wastebasket which is adapted to receive and hold an inner liner in place, which wastebasket overcomes the inherent disadvantages of known wastebaskets and trash receptacles.

In accordance with one form of the present invention, wastebasket or trash receptacle includes a container formed with a bottom wall and side walls, and an upper rim defining an open end on the container. A lid is pivotally mounted on the container and is adapted to cover the open end.

The wastebasket further includes a structure for releasably retaining an inner liner in the container. This structure includes a bezel which is pivotally mounted on the container at its open end. The bezel is pivotable about a pivot axis between a first position, where the bezel is disposed substantially co-planarly with the upper rim of the container, and at least a second position, where at least a portion of the bezel is raised above the rim of the container.

The container is adapted to receive in its interior an inner liner having an open end, and to hold the liner in an open condition by wedging a portion of the liner surrounding the open liner end between the bezel and the container when the bezel is in the first position, that is, situated on the container rim.

The wastebasket also includes structure which retains the bezel in the raised second position. The bezel retaining structure includes a portion of the bezel having a protruding member, and a resiliently yieldable portion of the side wall of the container. The protruding member is movable radially about the pivot axis of the bezel to slidably engage the side wall portion. The resiliently yieldable side wall portion exerts a force on the protruding member of the bezel, which force must be overcome to raise the bezel from the first position to the second position. In the raised second position, the protruding member of the bezel rests on a bevelled corner of the side wall portion and is thus maintained in a raised position preferably at an angle above the rim of the container.

A preferred form of the wastebasket, as well as other embodiments, objects, features and advantages of this invention, will be apparent from the following detailed description of illustrative embodiments thereof, which is to be read in connection with the accompanying drawings.

DETAILED DESCRIPTION OF THE PREFERRED EMBODIMENTS

Figure 1:
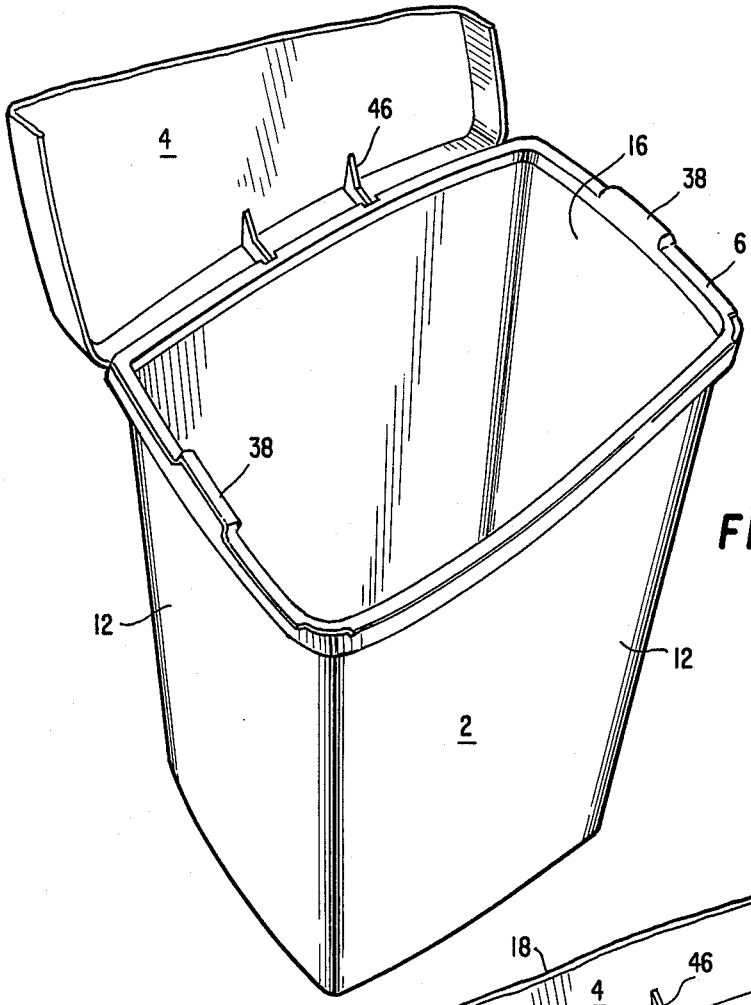
FIG. 1 is a top perspective view of the wastebasket of the present invention shown with the lid open.
Figure 2:
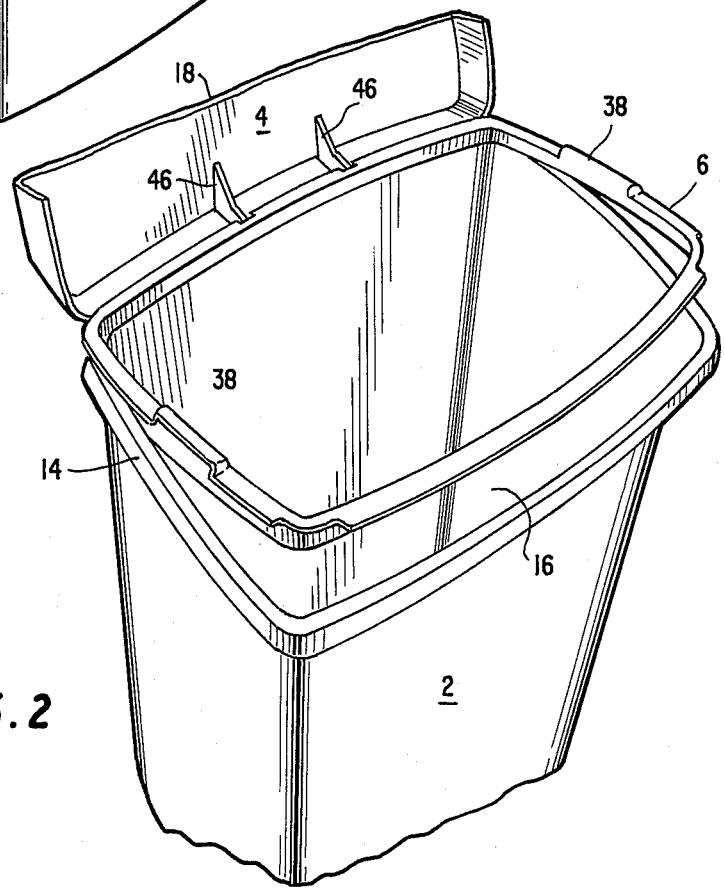
FIG. 2 is a top perspective view of the wastebasket with its retaining bezel shown in a partially raised position.
Figure 3:
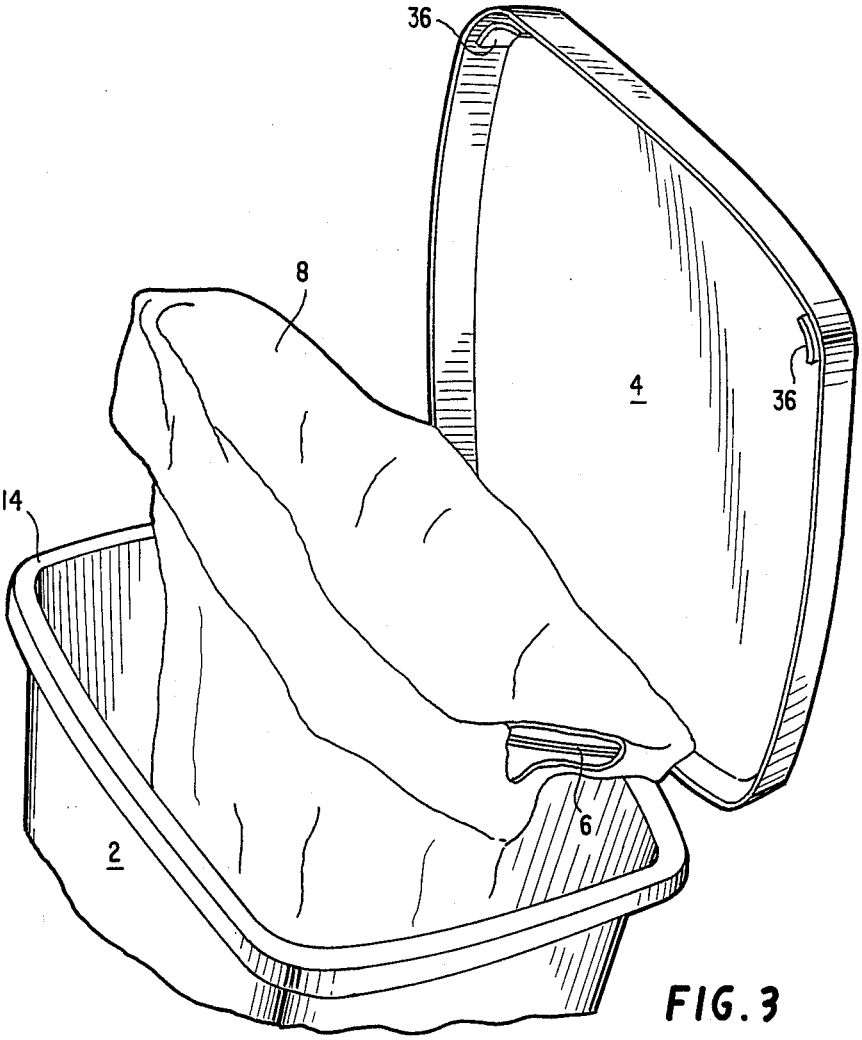
FIG. 3 is a perspective view of a portion of the wastebasket shown with an inner liner fitted over the retaining bezel.

Initially referring to FIGS. 1–10 of the drawings, a wastebasket constructed in accordance with the present invention basically includes a container 2, a lid 4 pivotally mounted on the container, and a bezel 6 for holding an inner liner 8 within the container.

In one preferred form, the container 2 includes a bottom wall 10 and several side walls 12 joined together and to the bottom wall. The upper edges of the side walls 12 form the upper rim 14 of the container, which upper rim defines an open end 16 to receive refuse.

The lid 4 is pivotally mounted on the container and is adapted to cover the container's open end 16. The lid 4 basically includes a flat top 18 and a downwardly extending edge 20, which edge extends below the rim 14 of the container on all sides and hides the rim from view, for aesthetic purposes.

The lid 4 may be lowered and raised to cover and uncover the open end of the container 2. The container 2 may be provided with a mechanism for raising or lowering the lid, such as a foot pedal (not shown), or more simply, the lid 4 may be raised and lowered by hand.

As mentioned previously, the wastebasket is adapted to receive an inner liner 8 and to hold the inner liner in place. A bezel 6 is provided for this purpose, which bezel is pivotally mounted on the container 2 at the container's open end. The bezel 6 is pivotable between an open position, where at least a portion of the bezel is raised above the rim 14 of the container, and a closed position, where the bezel 6 is disposed substantially co-planarly with the upper rim 14 of the container.

Figure 5:
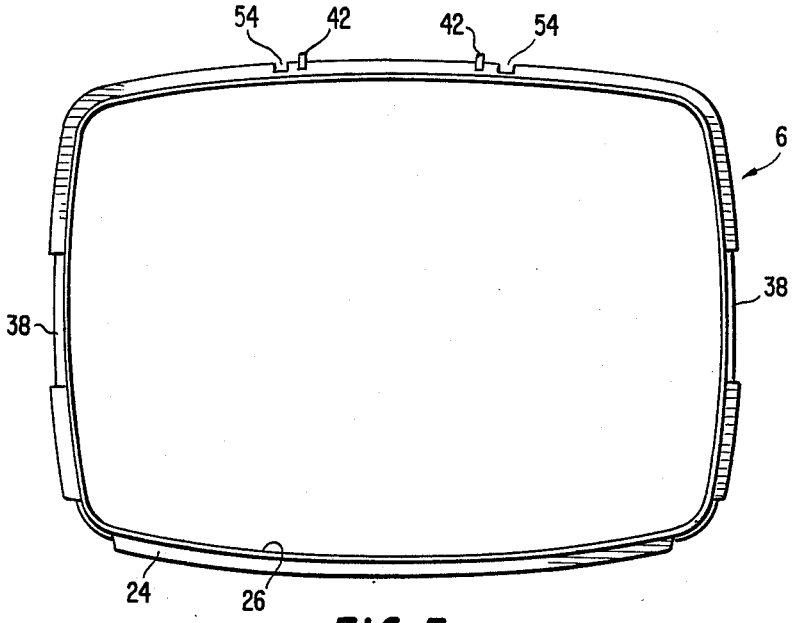
FIG. 5 is a bottom elevational view of the bag retaining bezel.
Figure 6:
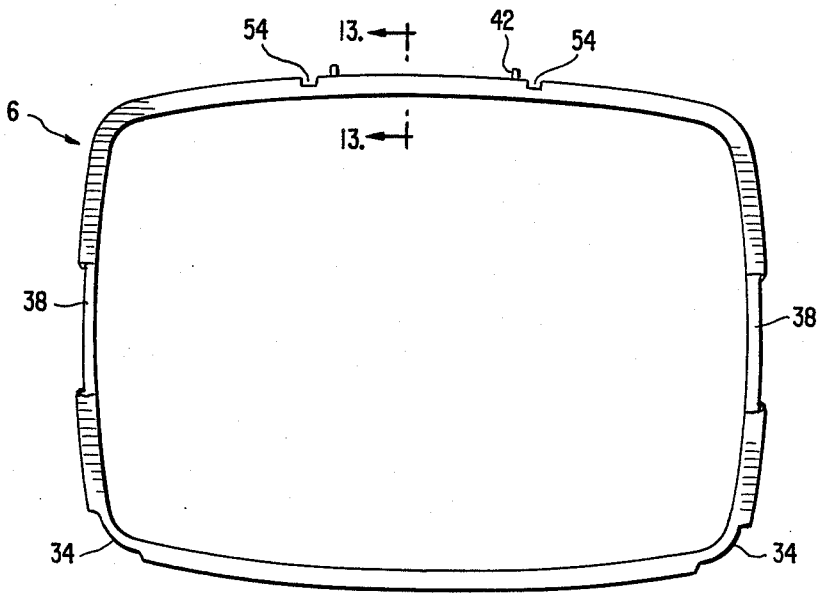
FIG. 6 is a top elevational view of the bag retaining bezel.
Figure 7:
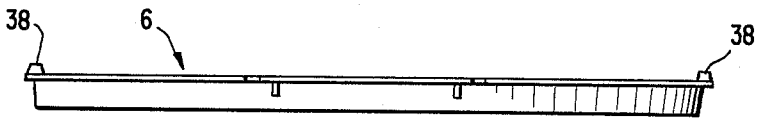
FIG. 7 is a rear elevational view of the bezel.

As shown in FIGS. 5–7, the bezel 6 conforms to the inner peripheral shape of the container 2 and is L-shaped in cross-section. It includes a horizontal, flat seat portion 24 which is adapted to rest on the container rim 14 when the bezel is in the closed position, and a depending leg portion 26 which is perpendicular to the seat portion 24 and which is adapted to abut against the inside surface of the container side walls 12, also when the bezel is in the closed position.

Figure 18:
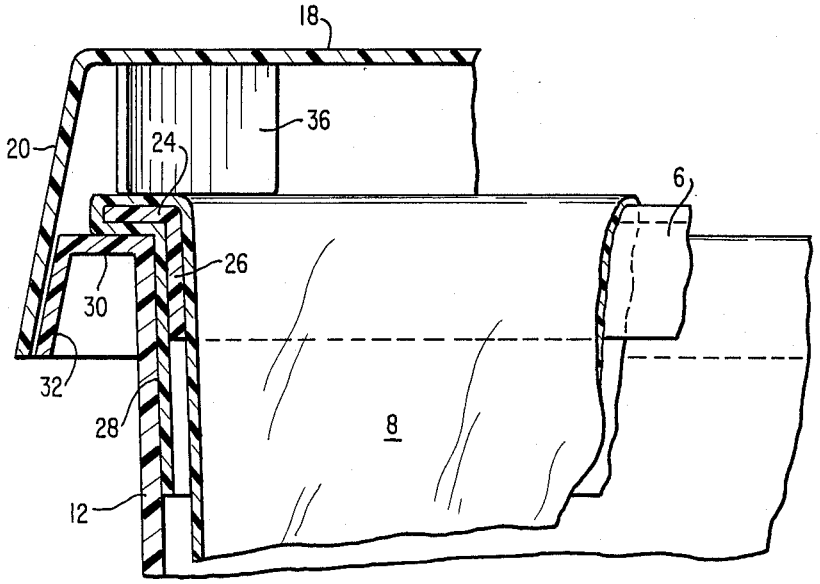
FIG. 18 is a partial sectional view of the wastebasket, illustrating the interfitting relationship between the lid, bezel and container portion of the wastebasket, with an inner liner in place.

By engaging the side walls of the container, the bezel 6 and the container 2 provide an interference fit for holding the inner liner 8 in place, as illustrated by FIG. 18. The inner liner 8, which has an open end, is placed in the interior of the container, and the material surrounding the open end is wrapped about the bezel 6 and is wedged between the bezel and the container side walls 12. Thus, the edge portion 28 of the inner liner 8 surrounding the liner's open end is not exposed to view, as it extends downwardly inside the container 2. This provides the wastebasket with a neat appearance.

The upper rim 14 of the container may be formed with a horizontal, flat upper surface 30 and a depending edge portion 32 which extends outwardly and downwardly, preferably at an angle, from the flat upper surface 30. This overall downturned shape of the rim 14 provides additional strength and rigidity to the container, especially at its open end.

The seat portion 24 of the bezel rests on the flat upper surface 30 of the container rim when the bezel is in its lowered position. The peripheral edge of the seat portion 24 of the bezel extends at most to, and not beyond, the peripheral edge of the rim's flat surface 30. In this way, the bezel does not interfere with the proper seating of the lid 4 on the container's rim 14.

Figure 8:
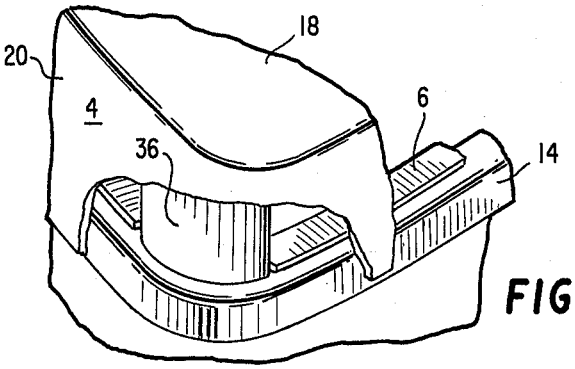
FIG. 8 is a perspective view of a corner portion of the wastebasket, with the lid partially broken away.

The forward corners 34 of the bezel's seat portion 24 are cut away to expose the upper surface 30 of the container's rim at the container's corners. The bezel 6 is cut away as described so that corner support members 36 projecting downwardly from the lid 4 and set slightly inwardly from the lid's forward corners may rest on the exposed portions of the container rim 14 and support the lid on the container when the lid is in a closed position, as shown in FIG. 8.

Figure 10:
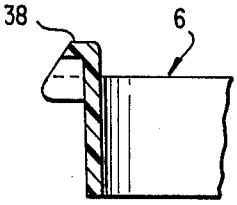
FIG. 10 is a sectional view of the bezel taken along line 10—10 of FIG. 9.
Figure 9:
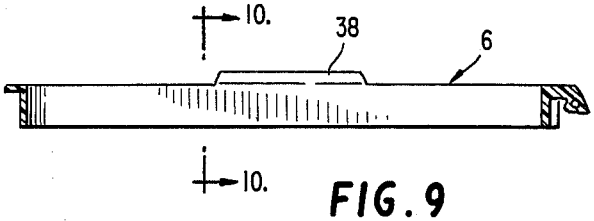
FIG. 9 is a side elevational view of the bag retaining bezel.

As shown in FIGS. 9 and 10, the bezel 6 is provided with hand grips 38 in the form of upwardly extending and outwardly turned flanges formed on opposite lateral sides of the bezel. The handles 38 provide an exposed edge for the user to lift with his fingers when raising the bezel 6 from its seated position on the container's rim.

Figure 4:
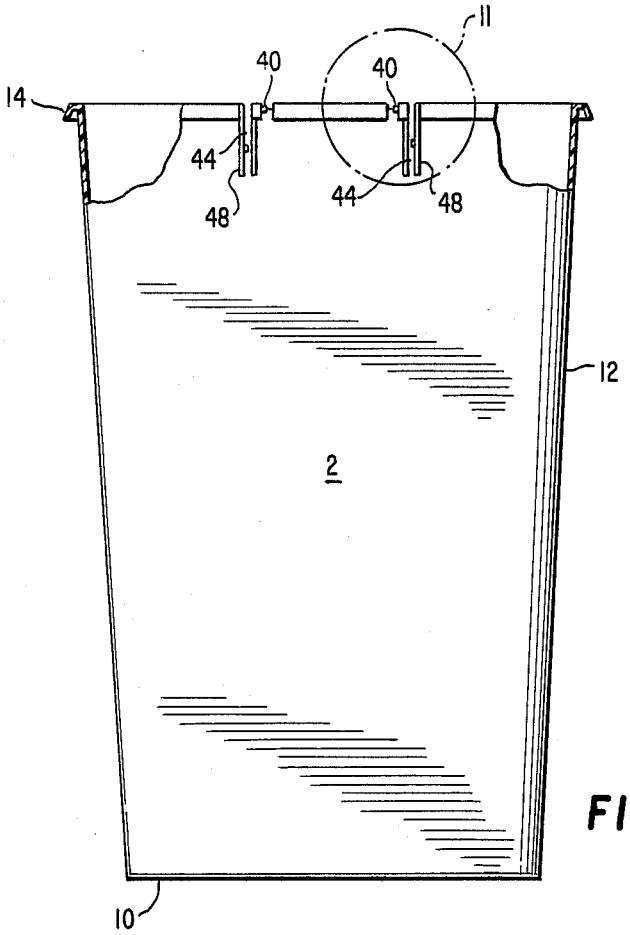
FIG. 4 is a rear elevational view of the wastebasket.
Figure 11:
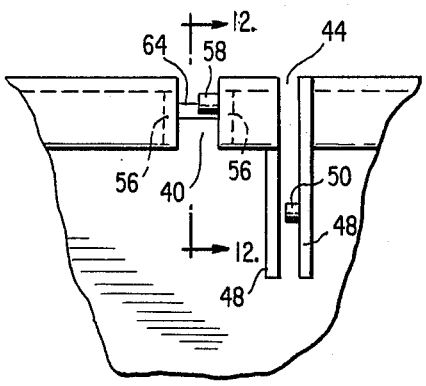
FIG. 11 is an enlarged view of a portion of the wastebasket shown encircled by dashed lines in FIG. 4.
Figure 12:
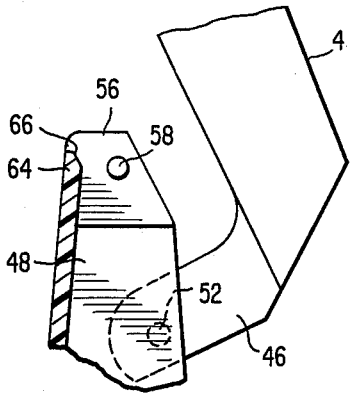
FIG. 12 is a sectional view taken along line 12—12 of FIG. 11.
Figure 13:
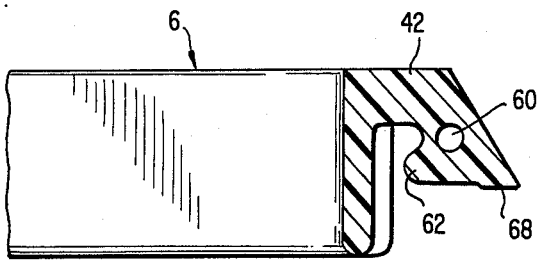
FIG. 13 is a partial sectional view of the bezel shown in FIG. 6 taken along line 13—13 of FIG. 6.
Figure 14:
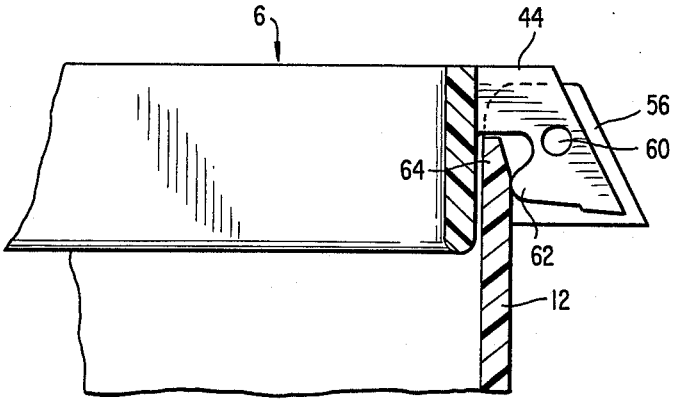
FIG. 14 is a partial sectional view of the wastebasket shown with the bezel mounted thereon and situated in a horizontal position.

As mentioned previously, the lid 4 and bezel 6 are each separately mounted on the container at or near its rim 14, and each pivots upwardly from the container. The structure of the wastebasket for pivotally mounting the bezel and the lid to the container is shown in FIGS. 4, 11 and 12, and will now be described.

The container rim 14 extends continuously about the open end 16 of the container except in four places where it terminates to define slots. One pair of slots 40 receive the hinge elements 42 of the bezel, which elements are formed as planar depending members joined to the bezel. The other pair of slots 44 receive comparable hinge elements 46 for the lid, which elements are similarly formed as planar depending members joined to the lid.

With respect to the lid mounting mechanism, two pairs of parallel, spaced-apart ribs 48 are provided on the container. The ribs 48 of each pair straddle a corresponding slot 44 and extend outwardly from the rear side wall of the container and downwardly from the container rim 14. A pin 50 extends from one rib 48 of each pair partially across the gap between the ribs, providing enough space between the free end of the pin 50 and the adjacent rib to allow the hinge elements 46 of the lid to be inserted between them. The lid hinge elements 46 are formed with apertures 52 through their thicknesses, which apertures receive the mounting pins 50. The lid is mounted on the container by force fitting the hinge elements 46 between the ribs 48 of the container and onto the mounting pins 50. Portions of the lid hinge elements 46 are received in the slots 44 of the rim and also in notches 54 which are formed in the periphery of the bezel 6. The bezel notches 54 and container rim slots 44 allow the lid to be seated closely on the container rim without its hinge elements 46 interfering with the fit of the lid on the container.

The other pair of slots 40 formed in the container rim receive the hinge elements 42 of the bezel. A pair of parallel container rim walls 56 straddle each slot 40 and are thus spaced apart from each other. A pin 58 mounted on one wall 56 of each pair extends partially across the slot 40, leaving enough space between the pin 58 and the adjacent rim wall 56 to fit a corresponding bezel hinge element 42 between them. Each bezel hinge element 42 is formed with an aperture 60 which receives a corresponding mounting pin 58. Like the lid, the bezel hinge elements 42 are force fitted onto their mounting pins 58 in their respective slots 40 so that the bezel and its hinge elements may pivot about the mounting pins between raised and lowered positions.

An important feature of the wastebasket of the present invention is its ability to lock the bezel 6 in a raised position, preferably at an angle of between 30° and 60° from the horizontal. This feature allows the user to free both hands to fit the inner liner 8 onto the bezel, without having to hold the bezel in the raised position. As will be described, the structure of the wastebasket which provides this feature is shown in FIGS. 13–17 of the drawings.

The hinge elements 42 of the bezel 6 include a portion or member 62 which protrudes inwardly toward the rear side wall 12 of the container. More specifically, the protruding portions 62 engage the container wall over portions 64 thereof which reside in the rim slots 40 between the rim slot walls 56. Because the rim 14 does not stiffen these portions of the container's side walls, the side wall portions 64 are resiliently yieldable when engaged by the protruding portions 62 of the bezel. The side wall portions include a bevelled outside corner 66 which, as will be seen, supports the bezel 6 in a raised position.

Figure 15:
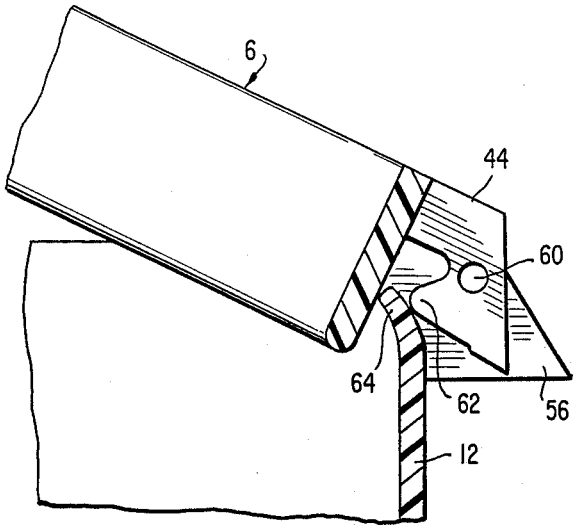
FIG. 15 is a partial sectional view similar to FIG. 14, illustrating the cooperation of the bezel and a side wall of the container as the bezel is being raised.

As the bezel 6 is raised from the container rim 14, the protruding portions 62 of its hinge elements move in a radial path about the pivot axis of the bezel and slidably engage respective container side wall portions 64, which portions are in the protruding member's radial path of movement. As a result, the side wall portions 64 are displaced slightly inwardly of the container 2, as illustrated by FIG. 15. Thus, the resiliently yieldable side wall portions 64 exert a force on the protruding portions 62 of the bezel hinge elements.

Figure 16:
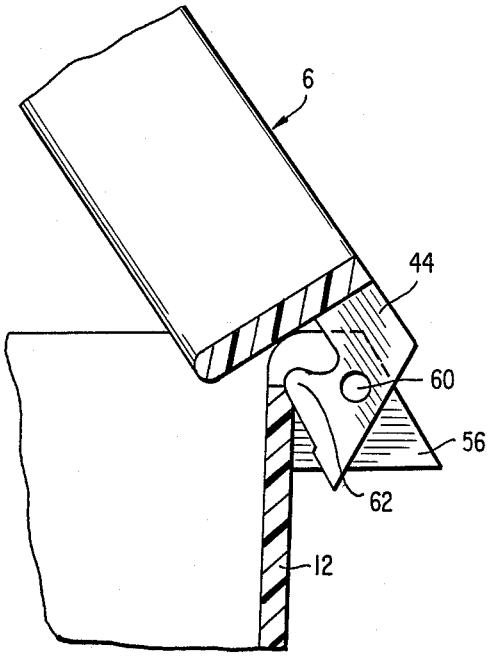
FIG. 16 is a partial sectional view similar to FIG. 14, illustrating the bezel in a locked, raised position.

When the bezel is in the raised position shown in solid lines in FIG. 16, the protruding members 62 pass the upper ends of the side wall portions 64 which, due to their resiliency, return to their original position. The underside surface of the protruding members 62 come to rest on the bevelled corner 66 of the side wall portions. In this manner, the bezel 6 is supported in a locked, raised position so that user has both hands free to position the inner liner 8. The user must exert a sufficient downward force on the bezel to overcome the force exerted by the resilient side wall portions 64 on the protruding members 62 to lower the bezel onto the container rim 14, as the force between the bezel and member when the bezel is inbetween the raised and lowered positions is greater than that existing when the bezel is resting on the bevelled corner of the side wall portion.

Figure 17:
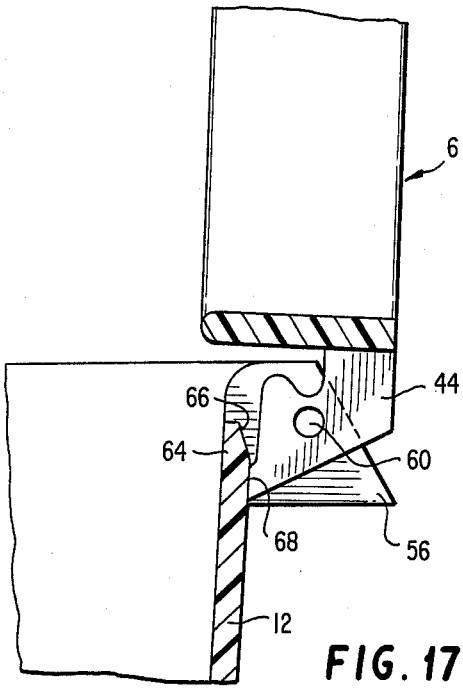
FIG. 17 is a partial sectional view of the wastebasket, illustrating the bezel mounted on the wastebasket and raised in a substantially vertical position.

Once the bezel 6 is raised to the position shown in FIG. 16, so that the protruding members 62 of its hinge elements clear the upper edge of the container side wall portions 64, the bezel may be further pivoted to a substantially vertical or slightly backwardly displaced position, as shown in FIG. 17, so that it does not obstruct the open end 16 of the container to facilitate removing a full inner liner from the container or for cleaning the wastebasket. To limit the bezel's backward pivotal movement beyond this substantially vertical disposition, a flattened stop surface 68 is provided on the underside of each hinge element 42 of the bezel, which stop surface engages the rear side wall 12 of the container, as shown in FIG. 17. The stop surfaces 68 resist further pivotal movement of the bezel and help prevent the dislodgement of the mounting pins 58 from the hinge element apertures 60 and damage to the wastebasket.

The wastebasket of the present invention securely holds the inner liner in place in the wastebasket. The bezel is easy to raise and lower, and can be locked in a raised, angular position so that the user may use both hands to fit the inner liner over the bezel. Furthermore, the wastebasket is simple in construction and may be easily assembled. The components of the hinges for mounting the bezel and of the structure for locking the bezel in a raised position may be integrally formed with either the bezel or the container and thus are not loose parts which may be lost or misplaced if the wastebasket is disassembled.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A wastebasket adapted to receive an inner liner, which comprises:

a container having side walls and an upper rim defining an open end;

a lid pivotally mounted on the container and adapted to cover the open end;

means for releasably retaining an inner liner in the container, the retaining means including a bezel pivotally mounted on the container at the open end thereof, the bezel being pivotable between a first position, wherein the bezel is disposed substantially co-planarly with the upper rim of the container, and at least a second position, wherein at least a portion of the bezel is raised above the rim of the container, the container being adapted to receive therein an inner liner having an open end and to hold the liner in an open condition by wedging a portion of the liner surrounding the liner open end between the bezel and the container when the bezel is in the first position;

means for pivotally mounting the bezel on the container, the bezel being pivotable about a pivot axis; and means for selectively retaining the bezel in the raised second position, the bezel retaining means including engagable first and second portions of the container and bezel, respectively, at least one of the first and second portions being resiliently yieldable due to engagement with the other portion and exerting a force on the other portion, which force must be overcome to effect movement of the bezel between the second and first positions.

2. A wastebasket as defined by claim 1, wherein the bezel is L-shaped in cross-section and includes a seat portion adapted to rest on the container rim when the bezel is in the first position, and a depending leg disposed substantially perpendicularly to the seat portion and which is adapted to abut against the inside surface of the container side walls when the bezel is in the first position.

3. A wastebasket as defined by claim 1, wherein the first portion of the bezel retaining means is an upper portion of a container side wall and the second portion is a protruding member affixed to the bezel, the protruding member being pivotable radially about the bezel pivot axis, the side wall portion of the container being disposed within the path of radial movement of the protruding member.

4. A wastebasket as defined by claim 3, wherein the the force with which the protruding member and side wall portions engage each other when the bezel is between the first and second positions is greater than the force between the two when the bezel is in the second position.

5. A wastebasket as defined by claim 3, wherein the side wall portion includes a bevelled corner, the protruding member resting on the bevelled corner when the bezel is in the second position.

6. A wastebasket as defined by claim 3, wherein the bezel is disposed at an angle from the horizontal when in the second position.

7. A wastebasket as defined by claim 6, wherein the angle at which the bezel is disposed when in the second position is between 30° and 60° from the horizontal.

8. A wastebasket as defined by claim 6, wherein the bezel is further positionable substantially upwardly vertically in a third position; and wherein the second portion of the bezel retaining means further includes a stop surface, the stop surface engaging a side wall of the container when the bezel is in the third position, the stop surface limiting further pivotal movement of the bezel with respect to the container beyond the third position.

9. A wastebasket as defined by claim 1, wherein the bezel mounting means includes a pin mounted on one of the bezel and the container, the pin being received in an aperture formed in the other of the bezel and the container.

10. A wastebasket as defined by claim 1, wherein the bezel includes a depending hinge member joined thereto, and the container includes a wall extending therefrom; and wherein the bezel mounting means includes a pin mounted on one of the depending member and the wall, the pin being received in an aperture formed in the other of the depending member and the wall.

11. A wastebasket adapted to receive an inner liner, which comprises:

a container having side walls and an upper rim joined to the side walls, the upper rim defining an open end of the container;

a lid pivotally mounted on the container and adapted to cover the open end;

means for releasably retaining an inner liner in the container, the retaining means including a bezel pivotally mounted on the container at the open end thereof, the bezel being pivotal between a first position, wherein the bezel is disposed substantially co-planarly with the upper rim of the container, and at least a second position, wherein at least a portion of the bezel is raised above the rim of the container, the container being adapted to receive therein an inner liner having an open end and to hold the liner in an open condition by wedging a portion of the liner surrounding the liner open end between the bezel and the container when the bezel is in the first position, the bezel being L-shaped in cross-section and including a seat portion adapted to rest on the container rim when the bezel is in the first position, and a depending leg disposed perpendicularly to the seat portion and adapted to abut against the inside surface of the container side walls when the bezel is in the first position;

means for pivotally mounting the bezel, the bezel being pivotable about a pivot axis; and means for retaining the bezel in the second position, the bezel retaining means including a bezel portion having a protruding member, and a resiliently yieldable portion of a side wall of the container, the protruding member being movable radially about the pivot axis to engage the yieldable side wall portion, the bezel portion further including a stop surface, the stop surface being engagable with a side wall of the container to limit pivotal movement of the bezel.

* * * * *